United States Patent [19]

Oscarsson

[11] Patent Number: 4,802,457

[45] Date of Patent: Feb. 7, 1989

[54] INTERNAL COMBUSTION ENGINE PROVIDED WITH A SUPERCHARGER

[75] Inventor: Johnny Oscarsson, Gustavsberg, Sweden

[73] Assignee: Svenska Rotor Maskiner AB, Stockholm, Sweden

[21] Appl. No.: 54,274

[22] PCT Filed: Oct. 10, 1986

[86] PCT No.: PCT/SE86/00467

§ 371 Date: May 14, 1987

§ 102(e) Date: May 14, 1987

[87] PCT Pub. No.: WO87/02417

PCT Pub. Date: Apr. 23, 1987

[30] Foreign Application Priority Data

Oct. 14, 1985 [SE] Sweden ..... 8504744

[51] Int. Cl.[4] ..... F02B 33/36; F02D 23/02

[52] U.S. Cl. ..... 123/564; 123/559.1; 60/397

[58] Field of Search ..... 60/397; 123/559, 564; 418/201

[56] References Cited

U.S. PATENT DOCUMENTS

| | | | |
|---|---|---|---|
| 678,570 | 7/1901 | Jones . | |
| 2,201,014 | 5/1940 | Scheerer | 123/559 |
| 2,266,820 | 12/1941 | Smith | 123/559 |
| 2,358,815 | 9/1944 | Lysholm . | |
| 3,045,447 | 7/1962 | Wagenius . | |
| 3,088,658 | 5/1963 | Wagenius | 418/201 |
| 3,108,740 | 10/1963 | Schibbye . | |
| 4,455,131 | 6/1984 | Werner-Larsen | 418/201 |
| 4,508,089 | 4/1985 | Baumgartner et al. | 60/397 |
| 4,667,646 | 5/1987 | Shaw | 123/559 |

FOREIGN PATENT DOCUMENTS

| | | | |
|---|---|---|---|
| 721465 | 6/1942 | Fed. Rep. of Germany | 123/564 |
| 31619 | 2/1986 | Japan | 123/559 |
| 112186 | 10/1944 | Sweden . | |
| 198588 | 9/1965 | Sweden . | |
| 549900 | 6/1942 | United Kingdom . | |

*Primary Examiner*—Michael Koczo

*Attorney, Agent, or Firm*—Frishauf, Holtz, Goodman & Woodward

[57] ABSTRACT

In a convention throttle-controlled internal combustion engine (1, 2) equipped with a supercharger which has the form of a compressor (10) provided with screw rotors (14, 15) arranged in a compression chamber, the supercharger is inactive at part engine loads. Since the engine normally operates at part loads for about 95% of its running time, efficiency is correspondingly poor. This drawback is overcome with the arrangement according to the invention in which the screw compressor (10) is provided on the inlet side (20) thereof with a capacity regulating device (22) which is operated by a gas pedal, or accelerator, and which when the engine is only partially loaded, is adjusted to a corresponding position in which the compressor (10) operates as an expander (3) of variable throttle effect on the engine inlet side (3) and transmits power to the engine, thereby replacing the conventional gas throttle.

8 Claims, 2 Drawing Sheets

INTERNAL COMBUSTION ENGINE PROVIDED WITH A SUPERCHARGER

BACKGROUND OF THE INVENTION

The present invention relates to an arrangement in a throttle-controlled internal combustion engine equipped with a supercharger in the form of an air compressor which comprises helical rotors (male and female rotors) located in a compression chamber and which is connected via a transmission arrangement to the crankshaft of the vehicle engine.

Known arrangements of this kind suffer the drawback of poor efficiency when the compressor is working at partial load. Another drawback encountered with such arrangements is that difficulties are encountered with regard to the mutual co-action between the supercharger and the fuel supply system. Furthermore, when passing from partial load to full load, there is a delay before full charging pressure is reached.

SUMMARY OF THE INVENTION

The object of the present invention is to provide a simplified arrangement of the aforesaid kind in which these drawbacks are avoided.

This object is achieved in accordance with the invention by means of an arrangement having the characteristic features set forth in the claims.

The invention is based on the concept that if a supercharger in the form of a screw compressor is provided on the compressor inlet side with a capacity regulating or control device, conventional with screw compressors (c.f. for instance Swedish Patent Specification No. 198 588), and the capacity is reduced the compressor will function as an expander or expansion machine, in the same manner as a gas throttle will throttle the engine suction inlet, and therewith transfer power to the engine. This can be achieved directly through the transmission, or indirectly by retarding the expansion machine, e.g. with the aid of a charging generator. The expansion effect can be increased by varying the transmission between the engine and the screw rotor machine, such that when the machine functions as an expander the transmission ratio is changed so that the screw rotor machine has a lower transmission ratio than when it functions as a compressor. This can readily be achieved by selectively effecting the drive through the male rotor when operated as an expander through the female rotor when operated as a compressor. This results in a reduction in fuel consumption when running at partial engine loads and when idling. The requirement of a gas throttle is eliminated, and fuel can be supplied readily to the engine in a manner which will also obviate the need for a conventional carburettor. A particularly important advantage is afforded when the arrangement incorporates a fuel supply device that has provided therein a plurality of supply apertures which are arranged to be exposed in sequence by the capacity regulating slide during its movement towards a fully open inlet port. This results in a well balanced increase in the fuel supply in proportion to the increase in engine load. Another specific advantage afforded by the invention is that the air of combustion is often cooled during its passage through the expansion machine, due to the expansion that takes place at part engine loads. Consequently, if the load on the engine should suddenly be rapidly increased, subsequent to the machine having previously functioned as an expander machine at partial engine loads, the still cool combustion air (cooled by cold surfaces downstream of the expander) is able to counteract knocking in the combustion chambers during this stepping-up period.

BRIEF DESCRIPTION OF THE DRAWINGS

The invention will now be described in more detail with reference to two exemplifying embodiments thereof illustrated in the accompanying drawings, in which.

DETAILED DESCRIPTION OF THE INVENTION

Figure 1:
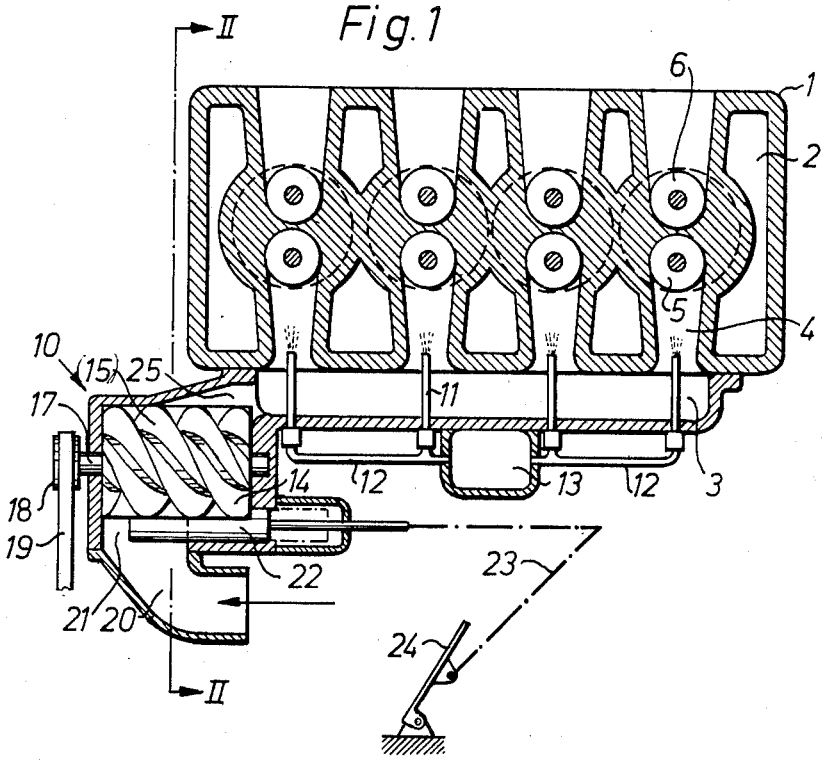
FIG. 1 is a sectional view of a first embodiment of the invention taken on the line I—I in FIG. 2.
Figure 2:
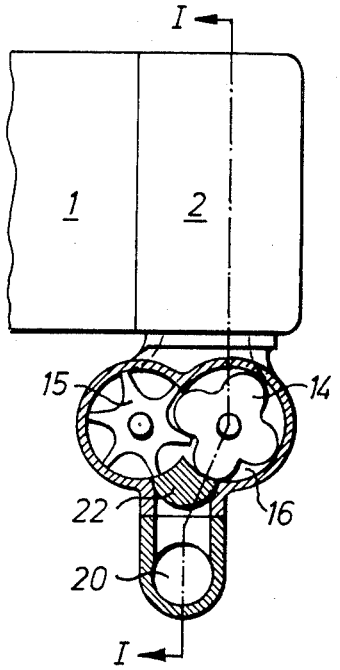
FIG. 2 is a sectional view taken on the line II—II in FIG. 3.

The embodiment illustrated in FIGS. 1 and 2 comprises a four-cylinder internal combustion engine 1, incorporating a cylinder head 2, a suction inlet manifold 3, suction inlet ducts 4, suction inlet valves 5, and exhaust valves 6.

The engine has no actual carburetor or gas throttle as such. Instead, the screw motor machine 10 is connected to the inlet manifold 3. Furthermore, the fuel jets 11 are located in the inlet ducts 4, which are formed as venturi pipes, and the jets 11 are connected through a pipe 12 to a fuel-containing float chamber 13.

The screw rotor machine incorporates two screw rotors, a male rotor 14 and a female rotor 15, which are journalled for rotation in a compression chamber 16 and are connected to the engine crankshaft (not shown) via a belt pulley 18 mounted on the shaft 17 of one rotor, and a drive belt 19 which passes around the pulley.

The machine includes an inlet 20 which leads to an inlet port 21, the effective area of which can be adjusted with the aid of a slide 22 which is mounted in, and forms part of, the wall of the chamber 16 for sliding movement parallel with the axes of the rotors 14, 15, said slide being referred to hereinafter as a capacity regulating slide and being connected to the gas pedal, or accelerator pedal 24 of the vehicle through a linkage system 23.

Screw rotor machines of this kind provided with capacity regulating valves adjacent the inlet port are well known to the art, and are found described and illustrated in the patent literature. Reference can be made in this latter regard to Swedish Patent Specification No. 219 243, which teaches alternative valve arrangements for the same purpose.

When the engine runs at partial engine loads, e.g. with the gas pedal released to an engine idling position, the screw rotor machine will function, in principle, as a gas throttle. Combustion air is drawn in through the inlet 20 and through the inlet port 21, which is adjusted to its smallest effective area by the slide 22, and enters the working chamber of the machine 10 and into the rotor grooves formed in said chamber, the air subsequently expanding in said grooves and departing through an outlet 25 to the suction inlet manifold 3 of the engine. The combustion air is drawn from the manifold 3 into the cylinder chambers of the engine, via the venturi inlet ducts 4, where fuel is entrained by suction from the jets 11.

As opposed to the case when the throttle control is effected with the aid of a gas throttle, the energy in this case is obtained from the machine 10, which functions as an expanding machine and consequently contributes toward rotation of the crankshaft through the transmission 18, 19.

The air is also cooled as it expands. Although only a very moderate effect is achieved herewith, as also with the aforesaid contribution to the crankshaft drive, the effect increases with increasing pressure conditions, such as when regarding engine speed at high engine revolutions. When the load on the engine is rapidly increased (by depressing the gas pedal) cold combustion air is momentarily delivered to the engine, therewith counter-acting the knocking tendency of the engine during acceleration. In addition hereto there is obtained the further advantage that immediately the gas pedal is depressed and the effective area of the port 21 subsequently widened, by movement of the slide 22 to the right in FIG. 1, a full charging pressure is applied to the engine. Normally, when supercharging an engine in a conventional manner, the supercharger is engaged, or activated, when the gas pedal is depressed and there is a delay of a second or two before the charging pressure has built-up. In the embodiment illustrated in FIGS. 1 and 2 fuel is supplied downstream of the screw rotor machine 10, which has the advantage of enabling the fuel jets 11 to be located close to the suction inlet valves 5. The embodiment illustrated in FIGS. 3–6 differs in this regard, since the fuel is supplied upstream of the screw rotor machine 10. This means that the screw rotor machine 10 operates with moist air, which is particularly advantageous in those cases in which the machine is equipped with asynchronized rotors 14, 15, i.e. the one rotor is arranged to drive the other. A machine of this kind is much simpler and requires less space than a machine with synchronized rotors. The moist conditions also improves the cooling of the machine and, in some cases, the lubrication of the mutually contacting surfaces of the rotor. The fuel is also mixed thoroughly with the air of combustion during passage through the machine. As will be understood from the following, the supply of fuel can be regulated readily and simply in response to the load on the engine, down to engine idling speeds, which is an additional advantage.

Figure 3:
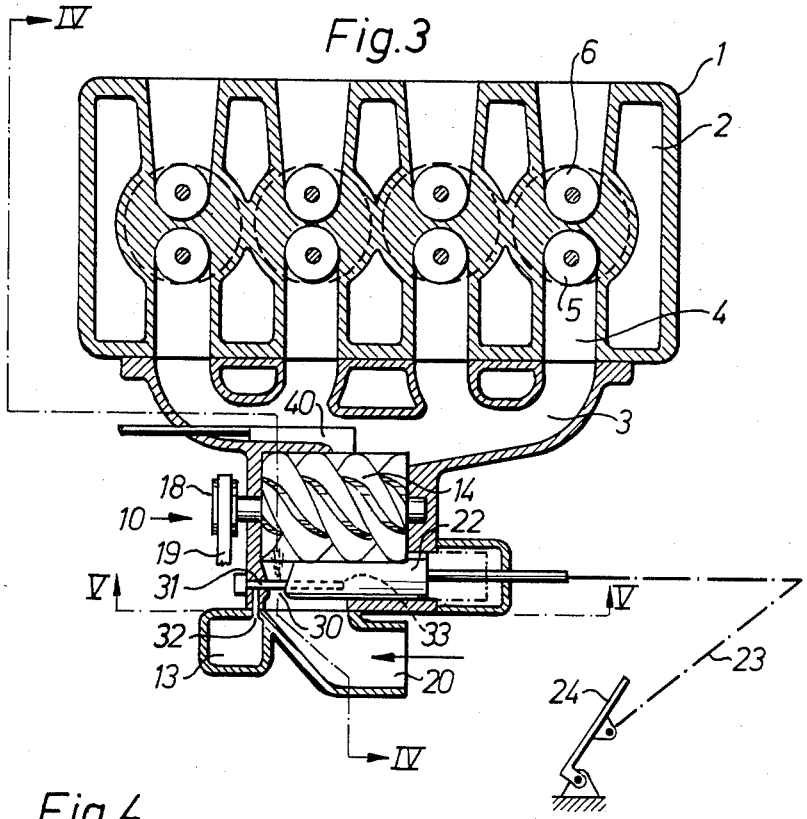
FIG. 3 is a sectional view of a second embodiment taken on the line III—III in FIG. 4.
Figure 4:
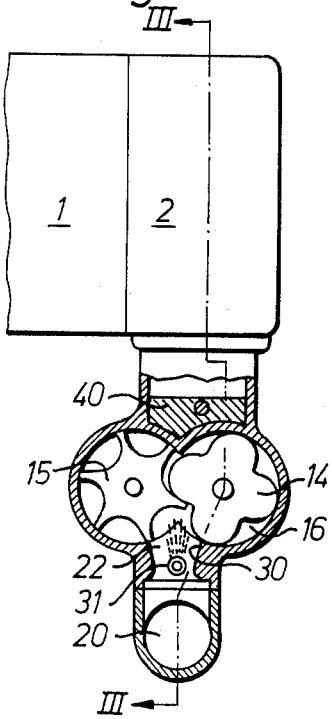
FIG. 4 is a sectional view taken on the line IV—IV in FIG. 3.
Figure 5:
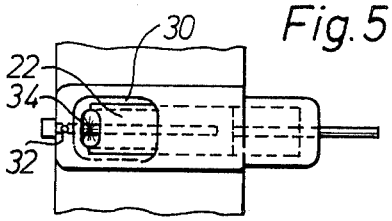
FIG. 5 is a sectional view taken on the line V—V in FIG. 3.
Figure 6:
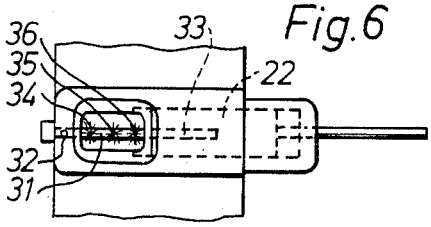
FIG. 6 is the same sectional view showing the capacity regulator set at full engine load.

In the embodiment illustrated in FIGS. 3 and 4, that part of the inlet 20 in which the regulating slide 22 is located, including the end surface of this slide, has the form of a venturi nozzle 30, seen in the direction in which the air of combustion passes. Extending in the narrowest part or throat of the nozzle 30, in the longitudinal direction of the slide, is a fuel delivery pipe 31, which passes from a fuel duct 32 communicating with a float chamber 13. The pipe 31 extends into a bore 33 with a certain amount of clearance in relation thereto, and is provided with a series of fuel jets 34, 35, 36, or has fuel outlet openings distributed therealong. When the slide 22 occupies its engine idling position (FIG. 5), the nozzle 30 is adjusted to its smallest effective area and the jets 35, 36 are covered by the wall of the bore 33. Despite the amount of inflowing combustion air per unit of time being minimal, the rate of air flow in the nozzle 30 is sufficiently high to entrain effectively by suction fuel from the jet 34, which is located in the best position in the venturi nozzle arrangement. When the engine load is increased, the slide 22 is moved slightly to the right in FIG. 5, to a position in which the next jet 35 in line is also exposed and the port leading to the interior of the screw rotor is sufficiently large for the machine to begin to work as a compressor driven by the crankshaft of the engine, via the belt 19 and the belt pulley 18, this latter effect being more applicable at full engine load, which is reached when the slide 22 occupies a position in which the port is opened to a maximum and all three jets 34–36 are exposed.

The screw rotor machine operates with a built-in pressure ratio equal to one (1) which means that the machine will not operate optimally as a compressor. This is not of great importance, however, since a vehicle engine will not run at full power, e.g. with supercharging, more than at most about 5% of the time. If the engine can be expected to run at full load over a longer period of time, the machine may be advantageously provided, in a known manner, with a control slide 40 for setting a suitable pressure ratio, as illustrated in FIGS. 3 and 4.

If additional fuel is required during acceleration, this can be achieved by supplying additional fuel to the screws with lower pressure in the compressor mode of the machine, with a similar effect to that achieved with an acceleration pump in a conventional carburetor system. In addition to the aforesaid advantages, the arrangement according to the invention will also save fuel when driving a vehicle at part engine loads or when idling the engine, which is also beneficial from a pollution aspect. The carburetor function is incorporated more or less in the actual inventive arrangement, which results in considerable savings, particularly since the embodiment according to FIGS. 1 and 2 is comparable with the provision of an individual carburettor for each cylinder.

The transmission means 18, 19 is arranged such that when the air compressor operates in a compressor mode, the engine drives the air compressor by the female rotor being coupled to the transmission drive means 18, 19, and when it is operated in an expander mode, it is driving said engine by the male rotor being coupled to the transmission drive means 18, 19.

The invention can also be applied to fuel injection engines and diesel engines, both with two-stroke and four-stroke engine designs.

I claim:

1. A throttle controlled internal combustion engine (1, 2) comprising:

a supercharger in the form of an air compressor (10), said air compressor comprising intermeshed helical screw rotors (14, 15) arranged in a compression chamber;

said air compressor (10) having a capacity regulating means (22) on an air inlet side (20) thereof;

control means coupled to said capacity regulating means (22) for regulating the power output of the engine, said control means including movable means for assuming positions corresponding to a partial engine load for adjusting said capacity regulating means (22) to corresponding positions in which the function of said air compressor (10) is switched to an expander mode with variable throttling effect on the sunction inlet side (3) of the engine and substitutes for a gas throttle, said air compressor (10) in said expander mode transferring power to the engine (1, 2); and said capacity regulating means including a valve slide means (22) arranged for axial movement in relation to said rotors (14, 15) and forming a movable wall part of said compression chamber of said air compressor (10), and also forming a movable wall part of a radial inlet port means (21), said radial inlet port means including a nozzle means (30) of variable area, said nozzle means (30) communicating with a fuel delivery means (31).

2. The engine of claim 1, wherein said fuel delivery means (31) comprises a plurality of fuel supply openings (34, 35, 36) arranged so as to be exposed sequentially by said valve slide means (23) of said capacity regulating means during movement of said valve slide means (22) towards a position in which said inlet port (21) is fully open.

3. The engine of claim 2, wherein said air compressor (16) comprises a control slide means (40) on the outlet side (25) thereof for setting an internal pressure ratio of said air compressor.

4. The engine of claim 1, wherein said air compressor (16) comprises a control slide means (40) on the outlet side (25) thereof for setting an internal pressure ratio of said air compressor.

5. The engine of claim 4, wherein said helical rotors (14, 15) of said air compressor (10) comprise male and female rotors; and further comprising drive means (18, 19) selectively coupled to said rotors, said drive means including means for driving said air compressor by said female rotor when said air compressor operates in a compressor mode, and means for furnishing power from said air compressor to said engine by said male rotor when said air compressor operates in an expander mode.

6. The engine of claim 3, wherein said helical rotors (14, 15) of said air compressor (10) comprise male and female rotors; and further comprising drive means (18, 19) selectively coupled to said rotors, said drive means including means for driving said air compressor by said female rotor when said air compressor operates in a compressor mode, and means for furnishing power from said air compressor to said engine by said male rotor when said air compressor operates in an expander mode.

7. The engine of claim 2, wherein said helical rotors (14, 15) of said air compressor (10) comprise male and female rotors; and further comprising drive means (18, 19) selectively coupled to said rotors, said drive means including means for driving said air compressor by said female rotor when said air compressor operates in a compressor mode, and means for furnishing power from said air compressor to said engine by said male rotor when said air compressor operates in an expander mode.

8. The engine of claim 1, wherein said helical rotors (14, 15) of said air compressor (10) comprise male and female rotors; and further comprising drive means (18, 19) selectively coupled to said rotors, said drive means including means for driving said air compressor by said female rotor when said air compressor operates in a compressor mode, and means for furnishing power from said air compressor to said engine by said male rotor when said air compressor operates in an expander mode.

* * * * *